US008613831B2

(12) United States Patent
Wild

(10) Patent No.: US 8,613,831 B2
(45) **Date of Patent: *Dec. 24, 2013**

(54) PAPER SUBSTRATES USEFUL IN WALLBOARD TAPE APPLICATIONS

(71) Applicant: International Paper Company, Memphis, TN (US)

(72) Inventor: Martha Patricia Wild, Marietta, GA (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/761,428

(22) Filed: Feb. 7, 2013

(65) Prior Publication Data

US 2013/0146242 A1 Jun. 13, 2013

Related U.S. Application Data

(63) Continuation of application No. 12/806,391, filed on Aug. 11, 2010, now Pat. No. 8,382,949, which is a continuation of application No. 11/377,914, filed on Mar. 16, 2006, now abandoned.

(60) Provisional application No. 60/662,170, filed on Mar. 16, 2005.

(51) Int. Cl.
*D21H 17/28* (2006.01)
*D21H 17/33* (2006.01)
*D21H 21/18* (2006.01)

(52) U.S. Cl.
USPC ..... 162/168.1; 162/135; 162/158; 162/175; 162/184

(58) Field of Classification Search
USPC ..... 162/135, 158, 168.1, 175, 183–185; 106/162.1, 206.1, 215.1
See application file for complete search history.

(56) References Cited

U.S. PATENT DOCUMENTS

| | | | | | |
|---|---|---|---|---|---|
| 2,256,853 | A | * | 9/1941 | Schwartz | 428/452 |
| 2,667,822 | A | | 2/1954 | Christman | |
| 3,336,247 | A | | 8/1967 | Williams | |
| 3,389,042 | A | | 6/1968 | Bieri et al. | |
| 3,392,085 | A | | 7/1968 | Oliver | |
| 3,616,165 | A | | 10/1971 | Nishi | |
| 3,630,830 | A | | 12/1971 | Herdle et al. | |
| 3,640,756 | A | | 2/1972 | Beersma et al. | |
| 3,767,604 | A | | 10/1973 | Hjermstad et al. | |
| 3,941,728 | A | | 3/1976 | Solenberger et al. | |
| 3,950,593 | A | | 4/1976 | Bomball et al. | |
| 4,022,965 | A | | 5/1977 | Goheen et al. | |
| 4,041,202 | A | | 8/1977 | Williams | |
| 4,042,739 | A | | 8/1977 | Emal et al. | |
| 4,075,136 | A | | 2/1978 | Schaper | |
| 4,128,286 | A | | 12/1978 | Windisch et al. | |
| 4,166,894 | A | | 9/1979 | Schaper | |
| 4,174,417 | A | | 11/1979 | Rydell | |
| 4,184,914 | A | | 1/1980 | Jenkins | |
| 4,294,888 | A | | 10/1981 | Antonio et al. | |
| 4,372,814 | A | | 2/1983 | Johnstone et al. | |
| 4,386,183 | A | | 5/1983 | Wempe | |
| 4,431,481 | A | | 2/1984 | Drach | |
| 4,440,830 | A | | 4/1984 | Wempe | |
| 4,448,639 | A | | 5/1984 | Long | |
| 4,496,427 | A | | 1/1985 | Davison | |
| 4,548,676 | A | | 10/1985 | Johnstone et al. | |
| 4,665,014 | A | | 5/1987 | Katsura | |
| 4,710,422 | A | | 12/1987 | Fredenucci | |
| 4,792,473 | A | | 12/1988 | Vitale | |
| 4,853,085 | A | | 8/1989 | Johnstone et al. | |
| 4,986,882 | A | | 1/1991 | Mackey et al. | |
| 5,011,741 | A | | 4/1991 | Hoffman | |
| 5,049,235 | A | | 9/1991 | Barcus et al. | |
| 5,160,789 | A | | 11/1992 | Barcus et al. | |
| 5,209,953 | A | | 5/1993 | Grupe et al. | |
| 5,240,500 | A | | 8/1993 | Retti | |
| 5,266,250 | A | | 11/1993 | Kroyer | |
| 5,350,630 | A | | 9/1994 | Schreiner et al. | |
| 5,360,420 | A | | 11/1994 | Cook et al. | |
| 5,443,899 | A | | 8/1995 | Barcus et al. | |
| 5,527,430 | A | | 6/1996 | Gill | |
| 5,531,728 | A | | 7/1996 | Lash | |
| 5,547,764 | A | | 8/1996 | Blais et al. | |
| 5,585,456 | A | | 12/1996 | Dulany et al. | |
| 5,613,335 | A | | 3/1997 | Rennich et al. | |
| 5,662,773 | A | | 9/1997 | Frederick | |
| 5,667,637 | A | | 9/1997 | Jewell et al. | |
| 5,685,815 | A | | 11/1997 | Bottorff et al. | |
| 5,698,074 | A | | 12/1997 | Barcus et al. | |
| 5,698,688 | A | | 12/1997 | Smith et al. | |
| H1704 | H | | 1/1998 | Wallajapet et al. | |
| 5,711,124 | A | * | 1/1998 | Stough et al. | 52/417 |
| 5,766,417 | A | | 6/1998 | Brungardt | |
| 5,773,131 | A | * | 6/1998 | Dettling | 428/201 |
| 5,836,122 | A | | 11/1998 | Rennich et al. | |
| 5,866,618 | A | | 2/1999 | Nguyen et al. | |
| 6,033,526 | A | | 3/2000 | Ehrhardt et al. | |
| 6,077,906 | A | | 6/2000 | Thiruvengada et al. | |
| 6,116,999 | A | | 9/2000 | Montross | |
| 6,126,783 | A | | 10/2000 | Gill | |
| 6,133,170 | A | | 10/2000 | Suenaga et al. | |

(Continued)

FOREIGN PATENT DOCUMENTS

| | | |
|---|---|---|
| AU | 2006213665 | 8/2006 |
| CA | 2508688 | 9/2006 |

(Continued)

OTHER PUBLICATIONS

Smook, Gary A., Handbook for Pulp and Paper Technologists, 2nd ed, Angus Wilde Publications, 1992, pp. 283-284.*

(Continued)

*Primary Examiner* — Dennis Cordray
(74) *Attorney, Agent, or Firm* — Thomas W. Barnes, III

(57) ABSTRACT

A paper substrate, particularly useful in wallboard tape applications containing PVOH on and/or in at least one surface of the paper, as well as methods of making and using the same. The use of the tape of the invention is used in conjunction with a joint compound that may contain no or reduced amounts of bonding agent.

12 Claims, No Drawings

(56) References Cited

U.S. PATENT DOCUMENTS

| | | | | |
|---|---|---|---|---|
| 6,146,494 | A | 11/2000 | Seger et al. | |
| 6,165,321 | A | 12/2000 | Pauley et al. | |
| 6,171,440 | B1 | 1/2001 | Staib | |
| 6,226,946 | B1 | 5/2001 | Stough et al. | |
| 6,226,957 | B1 | 5/2001 | Stough | |
| 6,228,219 | B1 | 5/2001 | Ehrhardt et al. | |
| 6,273,997 | B1 | 8/2001 | Ehrhardt et al. | |
| 6,299,686 | B1 | 10/2001 | Mills | |
| 6,306,255 | B1 | 10/2001 | Frolich et al. | |
| 6,316,095 | B1 | 11/2001 | Black et al. | |
| 6,355,137 | B1 | 3/2002 | Staib | |
| 6,361,651 | B1 | 3/2002 | Sun | |
| 6,432,237 | B1 | 8/2002 | Hasenkamp et al. | |
| 6,471,824 | B1 | 10/2002 | Jewell | |
| 6,500,057 | B1 | 12/2002 | Medina | |
| 6,506,282 | B2 | 1/2003 | Hu et al. | |
| 6,512,146 | B2 | 1/2003 | Pauley et al. | |
| 6,524,175 | B2 | 2/2003 | Beaudry et al. | |
| 6,579,414 | B2 | 6/2003 | Jewell | |
| 6,579,415 | B2 | 6/2003 | Jewell | |
| 6,582,557 | B2 | 6/2003 | Jewell | |
| 6,592,717 | B2 | 7/2003 | Jewell | |
| 6,595,632 | B1 | 7/2003 | Storfer-Isser et al. | |
| 6,722,092 | B2 | 4/2004 | Kunz et al. | |
| 6,729,949 | B1 | 5/2004 | McCoy | |
| 6,869,471 | B2 | 3/2005 | Odberg et al. | |
| 7,214,434 | B2 | 5/2007 | Dalgleish et al. | |
| 7,789,996 | B2 | 9/2010 | Buzza et al. | |
| 8,152,961 | B2 | 4/2012 | Buzza et al. | |
| 8,382,949 | B2 | 2/2013 | Wild | |
| 8,388,802 | B2 | 3/2013 | Buzza et al. | |
| 2001/0051687 | A1 | 12/2001 | Bazaj et al. | |
| 2002/0062938 | A1 | 5/2002 | Westman et al. | |
| 2002/0116884 | A1 | 8/2002 | Smythe | |
| 2002/0142136 | A1 | 10/2002 | Harel | |
| 2003/0024188 | A1 | 2/2003 | Smythe | |
| 2003/0091750 | A1 | 5/2003 | Chen | |
| 2003/0181114 | A1 | 9/2003 | Newton et al. | |
| 2003/0197028 | A1 | 10/2003 | Jaekel | |
| 2003/0213196 | A1 | 11/2003 | Harel | |
| 2004/0093816 | A1 | 5/2004 | Smyth | |
| 2004/0206467 | A1 | 10/2004 | Lindgren et al. | |
| 2004/0226675 | A1 | 11/2004 | Malmstrom et al. | |
| 2005/0155731 | A1 | 7/2005 | Martin et al. | |
| 2006/0191656 | A1* | 8/2006 | Buzza et al. | 162/158 |
| 2006/0231223 | A1 | 10/2006 | Ward et al. | |
| 2006/0254170 | A1 | 11/2006 | Goldman | |
| 2008/0057318 | A1 | 3/2008 | Adzima et al. | |
| 2008/0128070 | A1 | 6/2008 | Goldman | |
| 2008/0254317 | A1 | 10/2008 | Xu et al. | |
| 2008/0256886 | A1 | 10/2008 | Goldman | |
| 2010/0092725 | A1 | 4/2010 | Goldman | |
| 2010/0266835 | A1 | 10/2010 | Conboy | |
| 2011/0024067 | A1 | 2/2011 | Anderson et al. | |
| 2011/0108225 | A1 | 5/2011 | Buzza et al. | |
| 2012/0193055 | A1 | 8/2012 | Buzza et al. | |
| 2013/0153166 | A1 | 6/2013 | Buzza et al. | |

FOREIGN PATENT DOCUMENTS

| | | |
|---|---|---|
| EP | 0540076 | 1/2001 |
| EP | 1308558 | 5/2003 |
| EP | 1632604 | 3/2006 |
| GB | 791991 | 3/1958 |
| JP | 06073700 | 3/1994 |
| JP | 07070992 | 3/1995 |
| JP | 2001081700 | 3/2001 |
| KR | 2003093389 | 12/2003 |
| WO | 0149938 | 7/2001 |
| WO | 2005042843 | 5/2005 |
| WO | 2006050848 | 5/2006 |
| WO | 2006086736 | 8/2006 |
| WO | 2008066488 | 6/2008 |
| WO | 2010148156 | 12/2010 |

OTHER PUBLICATIONS

"Elvanol(R) in the Paper Industry", [online], du Pont de Nemours and Company, 1995-2004, 4 pages [retrieved on Jan. 4, 2009], Retrieved from the Internet: <URL:http://www2.dupont.com/Elvanol/en_US/assets/downloads/elvanol_in_paper_industry.pdf>.*

Smook, Gary A., Handbook for Pulp and Paper Technologists, 2nd ed, Angus Wilde Publications, 1992, pp. 220-227 and 283-284.

Polyvinyl Alcohol (PVA) Chemical and Technical Assessment (CTA), 2004, Food and Agriculture Organization of the United Nations, retrieved on Jun. 30, 2011. Retrieved from the Internet: URL ftp://ftp.fao.org/es/esn/jecfa/cta/CTA_61_PVA.pdf.

J. Peel, Paper Science and Paper Manufacture 1999, pp. 18-19.

DuPont "Elvanol(R) in the Paper Industry", online, du Pont de Nemours and Company, 1995-2004, 5 pages,retrieved on Jan. 4, 2009, Retrieved from the Internet: URL:http://www2.dupont.com/Elvanol/en_US/assets/downloads/elvanol_in_paper_industry.pdf.

Smook, Gary A., Handbook of Pulp and Paper Terminology, Angus Wilde Publications, 1990, pp. 283-284.

Braga et al., "Recent Developments in Wet Strength Chemistry Targeting High Performance and Ambitious Environmental Goals," Professional Papermaking Mar. 4, 2009, pp. 30-34.

* cited by examiner

PAPER SUBSTRATES USEFUL IN WALLBOARD TAPE APPLICATIONS

The present application claims the benefit of priority under 35 USC §119(e) to U.S. Provisional Patent Application 60/662,170, entitled "PAPER SUBSTRATES USEFUL IN WALLBOARD TAPE APPLICATIONS", filed Mar. 16, 2005, which is hereby incorporated, in its entirety, herein by reference.

FIELD OF THE INVENTION

This invention relates to paper products and/or substrates suitable for being made into wallboard tape (also may be known as joint tape) and more particularly relates to wallboard tape for taping joints between adjacent pieces of wallboard, having additives such as polyvinyl alcohol ("PVOH") or an equivalent thereof applied onto at least one surface of the tape and/or applied onto at least one surface and dispersed in the tape. The wallboard tape may be characterized by its excellent physical properties including CD tensile, MD tensile, wet tensile, hygroexpansivity, curl, lay-up bond, etc. The paper products of the invention may be produced by applying the PVOH or an equivalent thereof onto at least one side of a paper substrate during the paper making process as for example at the size press or at any other point in the paper making process.

BACKGROUND OF THE INVENTION

Wallboard (also known as drywall) has become the dominant material in the production of interior building partitions. In particular, interior building partitions generally comprise a studwall of spaced parallel vertical members (studs) which are used as a support for preformed panels (wallboard) which are attached to the studwall by screws, nails, adhesive or any other conventional attachment system. Obviously, joints exist between adjacent preformed panels. In order to provide a continuous flat surface to the wall, it is necessary to "finish" the joint between adjacent panels. Generally, such "finishing" may include the building up of multiple layers of a mastic material (joint compound) and the blending of this joint compound into the panel surface so as to form the desired flat and contiguous wall surface. In addition, wallboard tape may be used to bring together a plurality of panels forming a corner which may include but is not limited to corner bead.

In order to facilitate this finishing of the joints and/or corners, most manufacturers bevel the longitudinal edges of the wallboard panels so as to allow a build-up of mastic material which will then match the level of the major surface area of the preformed panel. Typically, the buildup of the mastic material in the joint area comprises the application of a first layer of mastic material, the embedding of a wallboard tape (for example a paper tape) in the first layer of mastic material and then the overcoating of the tape with one or more, generally two layers of additional mastic material. This finishing of the joints is a time consuming process, since it is generally necessary to wait 24 hours between each application of a coat of mastic material in order to allow the coat to dry before the application of an overcoat of an additional layer of mastic material. Moreover, it may then be necessary to sand the joint area so as to produce a finish which will match the major portion of the surface area of the wallboard panels. The "finishing" process thus is both time-consuming and labor-intensive.

Wallboard tape paper is a very challenging paper to make as there is a very narrow window of operation in which to achieve the required high tensile strengths while maintaining other good physical properties such as lay-up bond, hygroexpansivity, curl, etc. Refining carried out in the paper making process is one of the parameters that have been used to increase tensile strengths. However, if the fibers are refined too much, an increased number of convening and paper rejects may result.

Despite the considerable efforts which have been applied with the available products to solve the problem, there still existed a need for a wallboard tape to satisfy the construction industries requirements for a wallboard tape having highly sought after tensile strengths, lay-up bonds, etc.

SUMMARY OF THE INVENTION

One object of the present invention is a paper substrate containing a web of cellulose fibers and polyvinyl alcohol. In one aspect, the paper substrate of the present invention contains polyvinyl alcohol on and/or within the web of cellulose fibers. In another aspect, the paper substrate of the present invention is useful in the conversion to and/or useful as wallboard tape. In another aspect of the present invention, the paper substrate is neutral, acidic or alkaline. In yet another aspect of the present invention, the paper substrate has at least one surface of the substrate that is abraded, preferably sanded. In another aspect of the present invention, the paper substrate has a basis weight of from 50 to 120 lbs/3000 sq. ft. In yet another aspect of the present invention, the paper substrate has a CD tensile of from 5 to 60 lbf/inch width as measured by TAPPI method 494. In yet another aspect of the present invention, the paper has a MD tensile of from 25 to 100 lbf/inch width as measured by TAPPI method 494.

Another object of the present invention is a paper substrate containing a web of cellulose fibers and from 0.05 to 20 wt % polyvinyl alcohol based on the total weight of the substrate. In one aspect, the paper substrate of the present invention contains polyvinyl alcohol on and/or within the web of cellulose fibers. In another aspect, the paper substrate of the present invention is useful in the conversion to and/or useful as wallboard tape. In another aspect of the present invention, the paper substrate is neutral, acidic or alkaline. In yet another aspect of the present invention, the paper substrate has at least one surface of the substrate that is abraded, preferably sanded. In another aspect of the present invention, the paper substrate has a basis weight of from 50 to 120 lbs/3000 sq. ft. In yet another aspect of the present invention, the paper substrate has a CD tensile of from 5 to 60 lbf/inch width as measured by TAPPI method 494. In yet another aspect of the present invention, the paper has a MD tensile of from 25 to 100 lbf/inch width as measured by TAPPI method 494.

Another object of the present invention is a paper substrate containing a web of cellulose fibers and polyvinyl alcohol that is from 75 to 100% hydrolyzed. In one aspect, the paper substrate of the present invention contains polyvinyl alcohol on and/or within the web of cellulose fibers. In another aspect, the paper substrate of the present invention contains from 0.05 to 20 wt % polyvinyl alcohol based on the total weight of the substrate. In another aspect, the paper substrate of the present invention is useful in the conversion to and/or useful as wallboard tape. In another aspect of the present invention, the paper substrate is neutral, acidic or alkaline. In yet another aspect of the present invention, the paper substrate has at least one surface of the substrate that is abraded, preferably sanded. In another aspect of the present invention, the paper substrate has a basis weight of from 50 to 120 lbs/3000 sq. ft. In yet another aspect of the present invention, the paper substrate has a CD tensile of from 5 to 60 lbf/inch width as measured by TAPPI method 494. In yet another aspect of the present invention, the paper has a MD tensile of from 25 to 100 lbf/inch width as measured by TAPPI method 494.

Another aspect of the present invention is a paper substrate containing a web of cellulose fibers, polyvinyl alcohol, and starch. In one aspect, the paper substrate of the present invention contains polyvinyl alcohol and/or starch independently or together on and/or within the web of cellulose fibers. In another aspect, the paper substrate of the present invention is useful in the conversion to and/or useful as wallboard tape. In another aspect of the present invention, the paper substrate is neutral, acidic or alkaline. In yet another aspect of the present invention, the paper substrate has at least one surface of the substrate that is abraded, preferably sanded. In another aspect of the present invention, the paper substrate has a basis weight of from 50 to 120 lbs/3000 sq. ft. In yet another aspect of the present invention, the paper substrate has a CD tensile of from 5 to 60 lbf/inch width as measured by TAPPI method 494. In yet another aspect of the present invention, the paper has a MD tensile of from 25 to 100 lbf/inch width as measured by TAPPI method 494.

Another aspect of the present invention is a paper substrate containing a web of cellulose fibers, from 0.05 to 20 wt % polyvinyl alcohol, from 0.05 to 20 wt % starch. In one aspect, the paper substrate of the present invention contains polyvinyl alcohol and/or starch independently or together on and/or within the web of cellulose fibers. In another aspect of the present invention, the polyvinyl alcohol that is from 75 to 100% hydrolyzed. In another aspect, the paper substrate of the present invention is useful in the conversion to and/or useful as wallboard tape. In another aspect of the present invention, the paper substrate is neutral, acidic or alkaline. In yet another aspect of the present invention, the paper substrate has at least one surface of the substrate that is abraded, preferably sanded. In another aspect of the present invention, the paper substrate has a basis weight of from 50 to 120 lbs/3000 sq. ft. In yet another aspect of the present invention, the paper substrate has a CD tensile of from 5 to 60 lbf/inch width as measured by TAPPI method 494. In yet another aspect of the present invention, the paper has a MD tensile of from 25 to 100 lbf/inch width as measured by TAPPI method 494.

Any of the above objects and aspect of the present invention, may be achieved, in part, another object of the present invention that relates to a method of making the paper substrate of the present invention by contacting the polyvinyl alcohol and optionally starch with the cellulose fibers. In another aspect of the present invention, the polyvinyl alcohol and optionally starch may be contacted with the cellulose fibers consecutively or simultaneously. In another aspect of the present invention, the substrate may be made by contacting polyvinyl alcohol and optionally starch with the cellulose fibers during at least one point in the paper-making process. In another aspect of the present invention, the substrate may be made by contacting polyvinyl alcohol and optionally starch with the cellulose fibers during at the head box, size press, water box and coater. In another aspect of the present invention, the substrate may be made by contacting the fibers with starch and polyvinyl alcohol so that the ratio of starch/polyvinyl alcohol is from 99 wt % starch/1 wt % polyvinyl alcohol to 5 wt % starch/95 wt % polyvinyl alcohol, wherein the wt % is based upon the total weight of the starch and polyvinyl alcohol. In another aspect of the present invention, the substrate may be made by contacting the fibers with polyvinyl alcohol at the size press at wt % solids from 1 to 10 wt % in aqueous solution based upon the total weight of the solution. In yet another aspect of the present invention, the substrate may be made by abrading at least one surface of the substrate.

Any and all of the above objects and embodiments may be further explained and augmented by the detailed description below, including methods of using and converting the substrate as/into wallboard tape.

DETAILED DESCRIPTION OF THE INVENTION

It had been observed by the inventor herein that the use of polyvinyl alcohol (PVOH) and equivalents thereof has brought about significant improved tensile strengths in grades of paper substrates, including those suitable for wallboard tape applications. Therefore, applying PVOH at the size press and/or coater, for example, to the available wallboard tape grade would likewise increase the CD dry tensile strength without either the wet tensile strength or the lay-up bonds thereof being adversely affected. Also, the presence of PVOH and equivalents thereof in the paper substrate, as well as an end product such as the preferred wallboard tape, may increase bonding between gypsum wallboard and the substrate/wallboard tape. Further, the presence of PVOH and equivalents thereof in the paper substrate, as well as an end product such as the preferred wallboard tape, may increase the strength of the interaction between the substrate/wallboard tape and joint compound.

Wallboard tape may be made from a paper substrate containing recycled fibers and/or virgin fibers. Recycled fibers differ from virgin fibers in that the fibers have gone through the drying process several times. Paper substrates containing recycled fibers may have no or reduced capillary action which may be the initial mode of entry of fluids into the paper. All the above mentioned factors may make the recycled paper less absorbent than the virgin piper when incorporated into a substrate for wallboard tape applications.

The paper substrate of the present invention may contain from 1 to 99 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood. The paper substrate of the present invention may contain from 50 to 100 wt %, preferably from 80 to 95%, cellulose fibers originating from softwood species based upon the total amount of cellulose fibers in the paper substrate. This range includes 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 50 to 0 wt %, preferably from 5 to 20%, cellulose fibers originating from hardwood species based upon the total amount of cellulose fibers in the paper substrate. This range includes 5, 10, 15, 20, 30, 40, and 50 wt %, including any and all ranges and subranges therein, based upon the total amount of cellulose fibers in the paper substrate.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc. means.

Examples of chemical means include, but is not limited to, conventional chemical fiber modification means. Examples of such modification of fibers may be, but is not limited to, those found in the following U.S. Pat. Nos. 6,592,717, 6,582,557, 6,579,415, 6,579,414, 6,506,282, 6,471,824, 6,361,651, 6,146,494, H1,704, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated in their entirety by reference.

Another example of fibers to be used by the present invention includes but is not limited to fiber produced where any of the above-mentioned fibers are treated so as to have a high ISO brightness. Examples of such fibers treated in this manner include, but is not limited to, those described in U.S. patent application Ser. No. 11/358,543, filed Feb. 21, 2006, and entitled "PULP AND PAPER HAVING INCREASED BRIGHTNESS", which is hereby incorporated, in its entirety, herein by reference.

The paper substrate according to the present invention may be made off of the paper machine having a basis weight of from 50 lbs/3000 sq. ft. to 100 lbs/3000 sq. ft. The basis weight of the substrate may be 50, 52, 54, 55, 56, 58, 60, 62, 64, 65, 66, 68, 70, 72, 74, 75, 76, 78, 80, 82, 84, 85, 86, 88, 90, 92, 94, 95, 96, 98 and 100 lbs/3000 sq. ft, including any and all ranges and subranges therein.

The paper substrate according to the present invention may have a width off the winder of a paper machine of from 15 to 100 inches and can vary in length. The width of the paper substrate may be 15, 20, 25, 30, 35, 40, 45, 50, 55, 60, 65, 70, 75, 80, 85, 90, 95, 100 inches, including any and all ranges and subranges therein.

Alternatively, the paper substrate according to the present invention may be cut into streamers that have a width of from 1.75 to 3.25 inches wide and may vary in length. The width of the paper substrate streamer may have a width of 1.75, 1.80, 1.85, 1.9, 1.95, 2.00, 2.10, 2.20, 2.30, 2.40, 2.50, 2.60, 2.70, 2.80, 2.90, 3.00, 3.05, 3.10, 3.15, 3.20, and 3.25 inches, including any and all ranges and subranges therein.

Further processing of the paper substrate according to the present invention may also include abrading the substrate anytime during its production and/or converting and/or use so long as to generate a nap in the substrate. A preferred method of abrading at least one surface of the paper substrate is a sanding method where any conventional sanding method commonly known in the papermaking art may be utilized. Examples of sanding such substrates/wallboard tape can be found in U.S. Pat. Nos. 6,524,175; 6,500,057; 6,729,949; 6,432,237; 6,116,999; and 5,613,335, as well as U.S. Published Patent Applications 20040093816; 20030197028; 20030024188; and 20020116884, all of which are hereby incorporated, in their entirety, herein by reference.

In accordance with the invention, the foregoing has now been achieved by provision of a paper product and more particularly a wallboard tape for use in the taping of joints between pieces of wallboard, prepared by applying PVOH or a dispersion thereof; to at least one surface of the paper and/or to at least one surface of the paper and dispersed in the paper. The wallboard tape produced exhibits increased CD dry tensile strength. When applied at the size press, PVOH may be applied at from 1 to 10 wt % solids in aqueous solution. The wt % PVOH solids may be 2, 3, 4, 5, 6, 7, 8, 9, and 10 wt %, including any and all ranges and subranges therein.

Polyvinyl alcohol (PVOH) is produced by hydrolyzing polyvinyl acetate (PVA). The acetate groups are replaced with alcohol groups and the higher the hydrolysis indicates that more acetate groups have been replaced. Lower hydrolysis/molecular weight PVOH are less viscous and more water soluble. One goal may be to increase penetration of the PVOH into the paper. Lower viscosity PVOH may penetrate more easily into the paper. The PVOH may then act as a binder to the joint compound when it comes into contact with the paper. It may then be necessary to use partially hydrolyzed PVOH with low viscosity and low molecular weight. The PVOH may have a % hydrolysis ranging from 100% to 75%. The % hydrolysis may be 75, 76, 78, 80, 82, 84, 85, 86, 88, 90, 92, 94, 95, 96, 98, and 100% hdrolysis, %, including any and all ranges and subranges therein.

The resultant paper substrate may then contain PVOH at a wt % of from 0.05 wt % to 20 wt % based on the total weight of the substrate. The wt % of PVOH contained by the substrate may be 0.05, 0.1, 0.2, 0.4, 0.5, 0.6, 0.7, 0.8, 0.9, 1, 2, 4, 5, 6, 8, 10, 12, 14, 15, 16, 18, and 20 wt %, including any and all ranges and subranges therein, based on the total weight of the substrate.

Starch may optionally be added at the size press with PVOH at from 0 to 30 wt % solids in aqueous solution. The wt % starch solids may be 1, 2, 3, 4, 5, 6, 8, 10, 12, 14, 15, 16, 18, 20, 22, 24, 25, 26, 28 and 30 wt %, including any and all ranges and subranges therein.

The resultant paper substrate when it contains starch may contain starch at a wt % of from 0.05 wt % to 20 wt % based on the total weight of the substrate. The wt % of starch contained by the substrate may be 0.05, 0.1, 0.2, 0.4, 0.5, 0.6, 0.7, 0.8, 0.9, 1, 2, 4, 5, 6, 8, 10, 12, 14, 15, 16, 18, and 20 wt %, including any and all ranges and subranges therein, based on the total weight of the substrate.

The ratio of starch solids/PVOH solids as applied at the size press may be from 100 wt % PVOH of solids (i.e. approximately no starch) to 99 wt % starch/1 wt % PVOH based on the total weight of the starch and PVOH solids. The ratio of starch/PVOH solids based on the total weight of the starch and PVOH solids may be 99/1, 95/5, 90110, 85/15, 80/20, 75/25, 70/30, 65/35, 60/40, 55/45, 50/50, 45/55, 40/60, 35/65, 30/70, 25/75, 20/80, 15/85, 10/90, 5/95, and 100 wt % PVOH (no starch solids), including any and all ranges and subranges therein.

The paper substrate of the present invention may have a MD tensile as measured by conventional TAPPI method 494 of from 25 to 100, preferably from 40 to 90 lbf/inch width. This range includes MD tensile of 25, 30, 35, 40, 45, 50, 55, 60, 65, 70, 75, 80, 85, 90, 95, and 100 lbf/inch width, including any and all ranges and subranges therein.

The paper substrate of the present invention may have a CD tensile as measured by conventional TAPPI method 494 of from 5 to 50, preferably from 20 to 50 lbf/inch width, most preferably 25 to 40 lbf/inch width. This range includes CD tensile of 5, 10, 15, 20, 25, 30, 35, 40, 45, and 50 lbf/inch width, including any and all ranges and subranges therein.

Table 1 below lists examples of compounds which may be used as chemical substitutes for the PVOH. This class of compounds is known as bonding agents and/or binders. This list of examples is in no way considered to be one that is exhaustive. Examples of binders include, but are not limited to, polyvinyl alcohol, Amres (a Kymene type), Bayer Perez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. These compounds may also increase tensile strength, fold and wet tensile strength. Still further, these compounds may be used either separately or in combination with one another and/or PVOH.

Different levels of hydrolyzed PVOH added to the surface of wallboard tape paper increases tensile strength without negatively impacting or significantly decreasing other physical properties such as wet tensile strength. To further increase a physical property such as wet tensile strength of the wallboard tape paper substrate, glyoxal (or other similar crosslinker such as Polycup) can be added to an optionally lower hydrolyzed PVOH.

Lower basis weight may reduce tensile strength; however, if the tensile strength is obtained by use of surface and/or wet-end additives (e.g. Armes (a Kymene type), Bayer Parez, etc.), then the paper's basis weight may be reduced without adverse results. Therefore, lower basis weight and caliper paper may be used to provide a smoother finish of the wallboard join and/or corner. Thus, a paper substrate containing PVOH may have increased strength properties which may allow more relaxed converting requirements.

The paper substrate of the present invention may also include optional substances including retention aids, sizing

TABLE 1

Examples of binders useful in wallboard Tape applications.

| | | | |
|---|---|---|---|
| | Group I | | |
| Airflex 456 | Polyvinyl Chloride Emulsion Vinyl Acetate-ethylene-vinyl chloride terpolymer | Adhesion to cellulose | pH = 4 6 6 anionic emulsion |
| PC 290 starch Penford Product CO. | Modified Hydroxyethyl starch 2-hydroxyethyl starch ether | Adhesion to cellulose | pH = 6-7.5 |
| Pearl AP Starch A. E. Staley Co. | Native Starch | Adhesion to cellulose | uncooked-4.6 |
| Baystrenght Bayer | Modified Polyserylamide | Adhesion to cellulose | pH = 2.8-3.4 viscous liquid |
| | Group II | | |
| Sequarez 755 OMNOVA | Polyol carbonyl adduct Aqueous Ethanedial/polyol condensate | reacts with functional groups not self crosslinking | pH = 4.5 liquid |
| Polycup 172 Hercules | Polyamide-epichlorohydrin aq sol'n | Crosslinking agents reacts with carboxyl and hydroxyl groups | pH = 4.7 cationic liquid |
| Kymene 557H Hercules | Polyamide-epichlorohydrin aq sol'n | Crosslinking agents reacts with carboxyl and hydroxyl groups | pH = 4.6-4.9 cationic liquid |
| Earthworks Link-Up Plus T-Square | Glyoxal Urea Condensate | Crosslinking agents carboxyl and hydroxyl groups react with fiber | pH = 5 liquid |
| Glyoxal 40% Aquous Solution Sigma-Aldrich | Glyoxal Ethanedial | Crosslinking agent reactive | pH = 2-3.5 liquid |
| Isovin E 1065 Bayer | Aliphatic Polisocyaniate 1,6 Hexamethylene Diisocyanate Based Polyisocyaniate | Reacts with OH groups | Liquid Non ionic |
| | Group III | | |
| Baysynthol PE 9000-Isovin E 1065 Bayer | Polyester Resin Dispersion-Aliphatic Polyisocyaniate | | Liquid |
| Baysynthol OH 1000-Isovin E 1065 Bayer | aqueous Polyacrylate Resin Dispersion - Aliphatic Polyisocyaniate | | Liquid |

Group I the four chemicals in Group I, behave like PVOH and they adhere to the cellulose These are chemically inert Group II. The following six chemicals in Group II, have reactive functional groups and these chemicals are cross-linking agents.

Group III The last two chemicals in Group III, are composed of two different polymers with the properties of the chemicals in Groups I and II.

agents, bulking agents, binders, fillers, thickeners, and preservatives. Examples of fillers include, but are not limited to; clay, calcium carbonate, calcium sulfate hemihydrate, and calcium sulfate dehydrate. A preferable filler is calcium carbonate with the preferred form being precipitated calcium carbonate. Other optional substances include, but are not limited to silicas such as colloids and/or sols. Examples of silicas include, but are not limited to, sodium silicate and/or borosilicates. Other examples of optional substances are solvents including but not limited to water.

While any method of application is appropriate, the preferred application of the PVOH in accordance with the invention involves using the size press and/or coater to apply the PVOH, most preferably the size press, on the surface of the wallboard tape grade to increase tensile strength while making sure that the surface chemistry and sheet structure modifications due to the PVOH addition do not adversely impact the lay-up bonds or wet tensile strength.

The PVOH can also be applied at the wet end rather than at the size press. Further, the PVOH may be applied via conventional coating methodologies and application techniques for the coating of paper substrates. Adding a binder to the wallboard tape may serve to accomplish making the paper stronger, and also may allow for the binder to react with the chemical organics of the joint compound to give better adhesion of the joint compound to the wallboard tape and the wallboard. When the fluid part of the joint compound may penetrate into the tape, it may then react with the PVOH and produce significantly better interaction between the compound and the paper (binder and fibers) thus improving a multitude of physical properties of the paper substrate for use in wall board tape applications.

The paper substrate may be made by contacting a plurality of cellulose fibers with a binder such as PVOH. Further, the contacting may occur in an aqueous environment having a pH of from 1.0 to 14.0, preferably from 2 to 12, most preferably from 3 to 11. The pH may be 1, 2, 3, 4, 5, 6, 7, 8, 9, 10, 11, 12, 13, and 14, including any and all ranges and subrange therein. Still further, the contacting may occur at an acceptable concentration levels that provide the paper substrate of the present invention to contain any of the above-mentioned amounts of cellulose fibers PVOH isolated or in any combination thereof. The contacting may occur anytime in the papermaking process including, but not limited to the thick stock, thin stock, head box, size press, water box, and coater. The cellulose fibers and binder such as PVOH may be contacted serially, consecutively, and/or simultaneously in any combination with each other. The cellulose fibers and binder such as PVOH may also be pre-mixed in any combination before addition to the paper-making process.

In one example, the paper substrates useful as wallboard tape may be made according to those described in U.S. patent application Ser. No. 11/352,941, "PAPER SUBSTRATES USEFUL IN WALLBOARD TAPE APPLICATIONS", filed Feb. 13, 2006, which is hereby incorporated, in its entirety, herein by reference.

These methods of making the paper substrate of the present invention may be added to any conventional papermaking processes, as well as converting processes, including abrading, sanding, slitting, scoring, perforating, sparking, calendaring, sheet finishing, converting, coating, laminating, printing, etc. Preferred conventional processes include those tailored to produce paper substrates capable to be utilized as wallboard tape. Textbooks such as those described in the "Handbook for pulp and paper technologists" by G. A. Smock (1992), Angus Wilde Publications, which is hereby incorporated, in its entirety, by reference.

The present invention is explained in more detail with the aid of the following embodiment example which is not intended to limit the scope of the present invention in any manner.

EXAMPLES

When starch was applied in place of PVOH at the size press with a view to increasing the strength of the paper, the starch increased dry tensile strength (Table 2). Further, wet tensile appeared to not be adversely affected.

TABLE 2

Starch Size Press Application on WBT

| | Testing Method | WBT Base Sheet | Starch @ 24.4 solids | % increase/ decrease compared to base sheet | Starch @ 14.4 solids | % increase/ decrease compared to base sheet |
|---|---|---|---|---|---|---|
| CD Tensile | LA mill 7 in (TAPPI Test Number T494 orn-1) | 32.7 | 44.9 | 37 | 41.4 | 27 |
| MD Tensile | LA mill 7 in TAPPI Test Number T494 orn-1) | 54.3 | 78.7 | 41 | 67.5 | 24 |

When PVOH was applied on the surface of the wallboard tape in accordance with the invention, the following results were obtained:

CD and MD tensile increased significantly (see Table 3 below),

MD wet tensile increased somewhat, and

Lay-up bonds for substrates having the various hydrolyzed PVOH coating compositions were varied.

TABLE 3

| PVOH Size Press application on WBT | | | | | | | | |
|---|---|---|---|---|---|---|---|---|
| | Testing Method | WBT Base Sheet | WBT with PVOH 425 | increase/ decrease compared to base sheet | WBT with PVOH 165 | increase/ decrease compared to base sheet | WBT with PVOH 103 | increase/ decrease compared to base sheet |
| CD Tensile | LA mill 7 in (TAPPI Test Number T494 orn-1) | 32.7 | 46.7 | 43 | 48.6 | 49 | 42.8 | 31 |
| MD Tensile | LA mill 7 in (TAPPI Test Number T494 orn-1) | 54.3 | 76.7 | 41 | 73.2 | 35 | 71.2 | 31 |

PVOH was applied so as to reside on and/or within the paper substrate suitable for use as wallboard tape using three different PVOH binders. Two of them were highly hydrolyzed (PVOH 103 and 165), while one was intermediately hydrolyzed (PVOH 425).

The presence of PVOH in the paper substrate, no matter what the hydrolysis level programmed therein, has a significant positive impact on tensile strength (see Table 3). Moreover, it appears as if the positive impact on wet strength created by the presence of PVOH in the paper substrate is always realized no matter what the hydrolysis level programmed therein. However, relative levels of hydrolysis programmed in the PVOH and contained in the paper substrate may or may not positively impact lay up bond, hygroexpansivity and curl properties of the paper. In addition, the above-mentioned impact of the presence of differently-hydrolyzed PVOH on the above-mentioned physical properties may be affected when combined with starch (see Table 2).

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiments.

What is claimed is:

1. A paper product having a CD tensile of from 5 to 60 lbf/inch width as measured by TAPPI method 494 and a MD tensile of from 25 to 100 lbf/inch width as measured by TAPPI method 494, comprising a paper substrate having a web of cellulose fibers and made into wallboard tape, wherein a wallboard and joint compound binder is applied to at least one abradable surface of the paper substrate, the wallboard and joint compound binder comprising: from 0.05 to 20 wt % starch based on the total weight of the paper substrate; and from 0.05 to 20 wt % polyvinyl alcohol based on the total weight of the paper substrate; in a ratio of starch/polyvinyl alcohol of from 99 wt starch/1 wt % polyvinyl alcohol to 5 wt % starch/95 wt % polyvinyl alcohol based on the total weight of the starch and polyvinyl alcohol, wherein the paper product further comprises a preservative.

2. The paper product according to claim 1, wherein the web of cellulose fibers comprises from 80 to 95% softwood fibers and from 5 to 20% hardwood fibers.

3. The paper product according to claim 1, wherein the paper substrate is neutral, acidic or alkaline.

4. The paper product according to claim 1, wherein the at least one surface of the paper substrate is abraded.

5. The paper product according to claim 1, wherein said polyvinyl alcohol is from 75 to 100% hydrolyzed.

6. The paper product according to claim 1, wherein the paper substrate has a basis weight of from 50 to 120 lbs/3000 sq. ft.

7. A method of making the paper product according to claim 1, comprising contacting the at least one abradable surface of said paper substrate with the preservative and the wallboard and joint compound binder; and converting the paper substrate contacted with the wallboard and joint compound binder into wallboard tape.

8. The method according to claim 7, wherein said contacting occurs during at least one point in a paper-making process, said point selected from at least one member selected from the group consisting of the head box, size press, water box and coater.

9. The method according to claim 7, wherein said contacting occurs at the size press.

10. The method according to claim 7, comprising contacting the at least one surface of the paper substrate with starch and polyvinyl alcohol at the same time.

11. The method according, to claim 7, wherein the at least one surface of the paper substrate is contacted at the size press with an aqueous solution comprising from 1 to 10 wt % polyvinyl alcohol based upon the total weight of the solution.

12. The method according to claim 7, further comprising abrading the at least one surface of the paper substrate.

* * * * *